United States Patent [19]

duPont

[11] 4,212,652

[45] Jul. 15, 1980

[54] APPARATUS AND SYSTEM FOR PRODUCING COAL GAS

[76] Inventor: Anthony A. duPont, 2300 Via Pacheco, Palos Verdes Estates, Calif. 90274

[21] Appl. No.: 893,715

[22] Filed: Apr. 5, 1978

[51] Int. Cl.[2] ..... C10B 3/02

[52] U.S. Cl. ..... 48/89; 48/99; 48/113; 48/120; 122/5; 165/141; 165/DIG. 5; 202/106; 202/126; 422/203; 422/204; 422/232

[58] Field of Search ..... 48/89, 99, 101, 102 A, 48/105, 107, 113, 120, 67, 73, 77, 197 R, 202, 210, 111; 23/277 R, 281 R; 122/5; 165/140, 141, 146, 147, DIG.5; 202/106, 126, 115, 127, 108; 432/210

[56] References Cited

U.S. PATENT DOCUMENTS

| | | | |
|---|---|---|---|
| 1,023,567 | 4/1912 | Huttinger | 48/67 |
| 1,639,394 | 8/1927 | Wunsch | 48/113 |
| 1,967,582 | 7/1934 | Marischka | 48/76 |
| 2,665,200 | 1/1954 | Kwauk | 48/210 |
| 3,433,713 | 3/1969 | Reid | 202/127 |
| 3,795,485 | 3/1974 | Bogart | 48/197 R |
| 3,909,299 | 9/1975 | Corrigan | 48/105 |
| 3,920,716 | 11/1975 | Spitz et al. | 48/197 R |
| 3,966,634 | 6/1976 | Sacks | 48/202 |
| 4,019,314 | 4/1977 | Springmann | 48/197 R |
| 4,029,481 | 6/1977 | Oliver et al. | 48/111 |

*Primary Examiner*—Richard V. Fisher
*Assistant Examiner*—George C. Yeung
*Attorney, Agent, or Firm*—Jessup & Beecher

[57] ABSTRACT

Apparatus and system for producing high pressure gas, such as high pressure coal gas from coal, air and water. Pulverized coal is introduced into a rising stream of steam in a central reaction column of a retort to constitute a fluidized or entrained bed. The coal reacts with the steam to form a gas consisting of hydrogen, carbon monoxide, carbon dioxide, nitrogen, methane and higher hydrocarbons. The retort is constructed so that product gas and air may be burned in an annular chamber surrounding the central reaction column to produce hot flue gas. The hot flue gas is used to drive a turbine which in turn, drives a compressor which introduces compressed air into the annular chamber. Steam tubes may be disposed in the annular space so that the steam introduced to the central reaction chamber may be super-heated by the hot flue gas. The high pressure in the annular chamber enables the pressure within the central reaction column to be relatively high without causing the hot wall surrounding the reaction column to rupture. This is because the high pressure in the central reaction column may be equalized by the high pressure in the annular chamber. The high internal pressure is contained by the cool outer pressure shell which is much more capable of withstanding stress than the hot walls forming the annulas.

5 Claims, 1 Drawing Figure

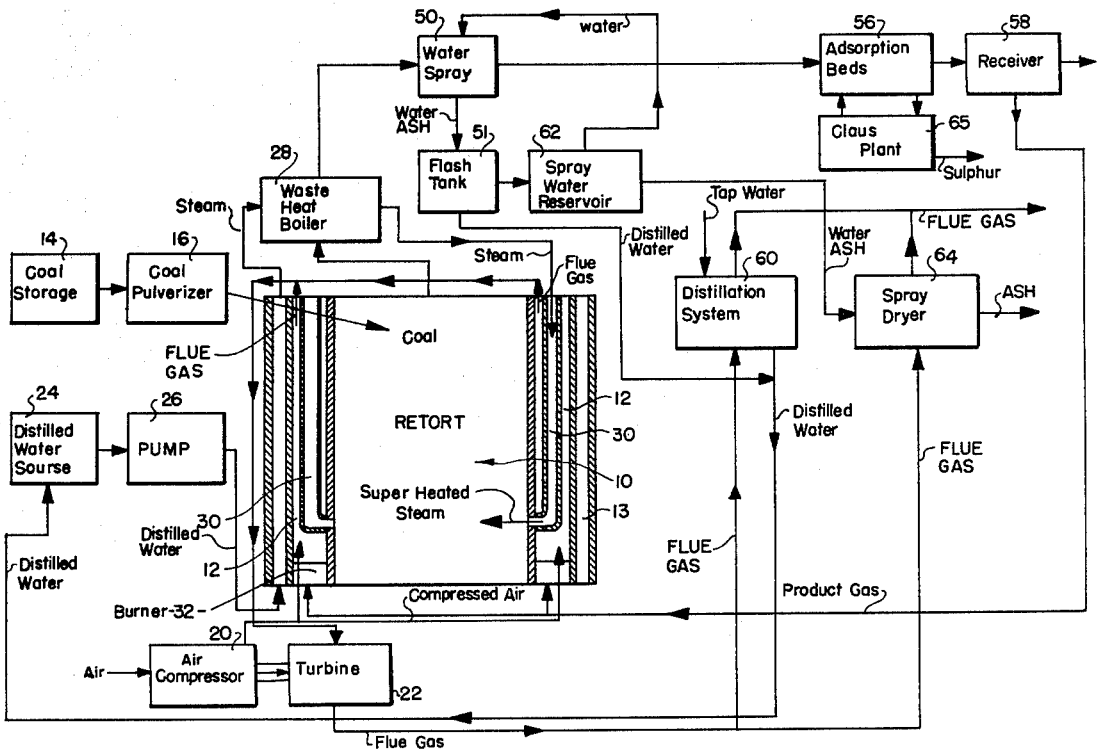

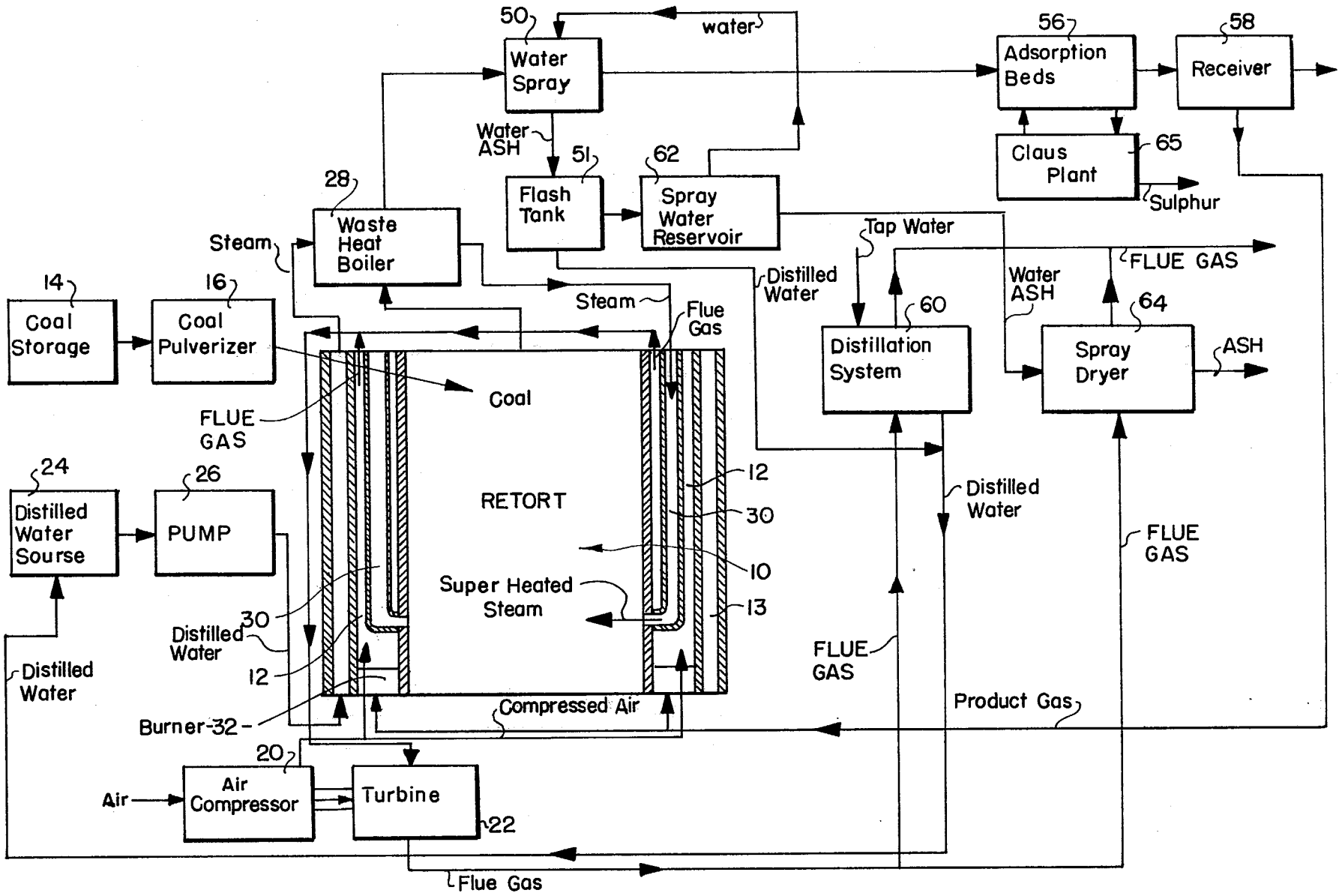
58
Receiver
56
Adsorption Beds
65
Claus Plant
Sulphur
FLUE GAS
64
Spray Dryer
ASH
FLUE GAS
Water ASH
Distilled Water
Product Gas
Tap Water
60
Distillation System
FLUE GAS
Distilled Water
water
62
Spray Water Reservoir
Flue Gas
12
30
10
13
Steam
50
Water Spray
Water ASH
51
Flash Tank
Coal
RETORT
Super Heated Steam
Compressed Air
22
Turbine
Flue Gas
28
Waste Heat Boiler
Steam
16
Coal Pulverizer
FLUE GAS
26
PUMP
30
Distilled Water
12
Burner 32
20
Air Compressor
Air
14
Coal Storage
24
Distilled Water Sourse
Distilled Water

APPARATUS AND SYSTEM FOR PRODUCING COAL GAS

RELATED CO-PENDING APPLICATION

Application Ser. No. 825,271, which was filed AUG. 7, 1977 in the names of duPont et al, now U.S. Pat. No. 4,137,052.

BACKGROUND OF THE INVENTION

In the past, many utilities have been using high sulphur coal in their power plants for generating electricity. However, recent clean air legislation has required that sulphur dioxide emissions from power plants be reduced, and this requirement has forced many utilities to switch to natural gas or fuel oil, or to install facilities for stack gas scrubbing. Unfortunately, none of the alternatives has proven to be commercially feasible. Natural gas and fuel oil are more expensive than coal, and in many instances are difficult or impossible to obtain because of shortages. Moreover, stack gas scrubbing processes are still in the development stage.

A better approach to the solution of the problem is the use of coal gas. In the production of coal gas, the sulphur in the coal is converted to hydrogen sulphide which can be readily removed by known adsorption processes. In addition, the coal gas can be produced under pressure permitting operation economy in existing power plants and more efficient design in future power plants, as compared with the coal-burning facilities. Gas produced under pressure from steam and carbon containing materials such as coal or petroleum cake makes an excellent feed stock for chemical processing or hydrogen production.

However, the prior art coal gas production systems require a plant with such a high capital cost that principal, interest, taxes and insurance alone mitigate any cost advantage over the use of coal in its original state. Moreover, when the additional costs of maintenance, operation and coal are added to the foregoing cost, the gas output of the prior art coal plants have a higher cost per unit heat (BTU) than any of the other competitive fuels. The system and apparatus of the present invention, on the other hand, has a dual advantage of low initial cost and lower maintenance. The system and apparatus of the invention is capable of producing a clean, medium BTU gas (300–500 BTU) which is much lower in cost than fuel oil and which is actually competitive with natural gas.

The system disclosed in the copending application includes one or more retorts, the number of retorts used being dictated by the gas requirements of any particular installation. The system of the copending application permits the control of temperature and coal residence time which assists production of methane and higher hydrocarbons. Therefore, a medium BTU coal gas (300–500 BTU) can be produced in the apparatus of the invention without the prior art requirements of an air separation plant for oxygen production and without the prior art requirements for a high pressure system.

The retort used in the apparatus of the copending application, as described therein, is designed with an outer wall in which an annular chamber is provided around the reaction column. The annular chamber may contain steam tubes in which the steam introduced into the reaction column is super-heated by flue gas. By such a construction, the walls of the reaction chamber in the retort are maintained at a higher temperature than the internal temperature of the column, so that any heat transfer through the walls is into the reaction column and not outwardly into the surrounding atmosphere. The retort itself may be modified to accommodate a wide range of different types of coal, and to produce coal gases with varying BTU and chemical compositions to satisfy specific requirements.

Heat will be transferred inwardly from the hot walls of the retort to the reaction column by radiation as long as the walls of the retort are above the reaction temperature in the reaction column. As described above, the apparatus of the copending application uses a retort in which flue gas is used to super-heat steam. This fluid gas passes along the outer surface of the walls of the retort column, so that the walls of the retort are always maintained at a higher temperature than the reaction temperature within the column.

It is often desirable to produce coal gas at high pressure. However, this cannot be achieved directly in the apparatus of the copending application because the hot wall surrounding the reaction column would rupture, if high pressure occurred in the reaction column. The apparatus and system of the present invention is similar to that of the copending application, except that the apparatus and system has been modified to give the retort the capability of producing the product gas at high pressure in a simple, economical, and efficient manner. This is achieved by creating a high pressure in the annular chamber so that the pressure in the reaction column can be raised to a high level without bursting the hot wall around the column.

BRIEF DESCRIPTION OF THE DRAWING

The single FIGURE is a block diagram of one embodiment of the coal gas producing system and apparatus of the invention.

DETAILED DESCRIPTION OF THE ILLUSTRATED EMBODIMENT

The apparatus shown in the drawing includes a retort designated generally as 10. The retort 10 includes a central reaction column, and it also includes a tapered annular chamber 12 surrounding the reaction column. Coal, or other carbon containing material, is obtained from coal storage 14, and is pulverized by a coal pulverizer 16, where it is crushed to approximately 10 mesh in the case of a fluidized bed or 200 mesh in the case of an entrained bed. The pulverized coal is introduced into the reaction column within retort 10 where it is blown into a rising stream of steam to form a gas consisting of hydrogen, carbon monoxide, carbon dioxide, nitrogen, methane and higher hydrocarbons. Air is compressed by a compressor 20 and introduced into the annular chamber 12. Compressor 20 is connected by a shaft 18 to a turbine 22 which is driven by the hot high pressure flue gas from annular chamber 12. The energy extracted from the flue gas by the turbine is put into the air compressed by the compressor and thus is returned to the process.

Distilled water from a source 24 is pumped by a pump 26 at high pressure either to a boiler (not shown) or up through a second annular chamber 13 of the retort, which is coaxial with annular chamber 12 and in which the water is heated or converted to steam. The water or steam is then introduced into a waste heat boiler 28 in which it is converted to super-heated steam, and the super-heated steam is fed to a super-heater (not shown)

where it is further super heated. The super-heated steam is then either fed directly into the retort 10, or it is fed into a number of tubular members 30 which are positioned in the annular chamber 12 in which the steam is further super-heated. The lower ends of the tubular members 12 are connected to the reaction column, so that the super-heated steam from the tubular member may be introduced into the lower end of the reaction column of retort 10. Pump 26 pumps the water to a desired high pressure, so as to provide steam at high pressure in the reaction column. In this way the product gas can be produced at high pressure, in a range, for example, of 500–100 psi.

The waste heat boiler 28 is a heat transfer device that removes heat from the high temperature product and excess steam leaving the retort, and uses the heat to boil water and super-heat the steam before it enters the retort. A super-heater (not shown) uses the flue gas leaving the annular chamber to super heat the steam. The outer annular chamber 13 can be used for additional boiler capacity and the tubular members 20 for additional super-heat capacity, if either is required to balance the process.

Appropriate burners 32 are provided at the lower end of annular chamber 12, and a portion of the product gas produced by the system is fed back to the burners and burned, causing a stream of hot flue gas to flow upwardly at high velocity in the annular chamber 12, heating the walls of the annular chamber by convection, and heating the super-heated steam in tubular member 30, if further super heating is desired. The heated outer wall radiates its heat to the inner wall which in turn radiates heat to the coal particles in the reaction column of the retort. Insulation surrounding the outer wall of the annular chamber permits only a small fraction of the order of a few percent, of the heat to be lost to the surroundings. The annular chamber 13 may be used to pick up this heat and use the heat to heat water or make steam. The heated flue gas from the annular chamber 12 is passed through a steam super-heater (not shown) and then through the turbine 22 to cause the turbine to drive compressor 20 so as to pressurize the air prior to its being fed into the lower end of annular chamber 12. In this way a pressure may be created in the annular chamber essentially equal to the pressure in the central reaction chamber, thus permitting high pressure coal gas to be produced directly in the central reaction chamber without rupturing the hot wall surrounding the column. The pressure inside the retort is contained by the cool outer pressure shell. Metal has a much higher strength at room temperature than at the elevated temperature of the annular walls. The energy otherwise required to compress the product gas is eliminated by the compressor, turbine combination.

The velocity of the heated flue gas through the annular chamber 13 must be high enough to provide sufficient convective heat transfer to produce enough heat radiation into the central chamber to react the carbon in the coal with steam. A tapered annular chamber, diminishing in area towards the top, is necessary to achieve uniform heat transfer. For example, the velocity of gas flowing through the central reaction chamber is less in a pressurized system than in an atmospheric system and may be of the order of 1–10 feet per second; and the velocity of gas in the annular chamber may be of 20–50 feet per second to produce the required heat transfer desired into the retort which is of the order of 40 BTU per square foot per second. Product gas of any desired high pressure, in a range, for example, of 500–1000 psi may be produced in the reaction chamber of retort 10.

The product gas from the reaction column of retort 10, after it has passed through the waste heat boiler 28, is fed to a water spray 50. The water spray 50 consists of a tank incorporating a number of water sprays through which the product gas passes after leaving the waste heat boiler. The water spray 50 serves to reduce the temperature of the product gas to approximately room temperature, and it also serves to condense the steam in the gas and also to remove fly ash and other particulate material from the gas.

The water and ash from water spray 50 is passed to a flash tank 51. The flash tank 51 may be a single stage flash evaporator. The exposure of the water and ash to low pressure in the flash tank causes a portion of the water to evaporate. The evaporated water is then condensed on appropriate cooling water condensing coils in the flash tank and recycled to the distilled water source 24 with water from a distillation system 60. The water and ash from the flash tank 51 is passed to a spray reservoir 62 in which the water is recovered for introduction to the water spray 50. The wet ash from reservoir 62 is dried in a spray dryer 64 and subsequently removed. The distillation system 60 is formed, for example, of a multi-stage flash evaporator. The evaporator uses the heat in the flue gas after it has left turbine 22 to distill, for example 25% of the water required in the retort 10. The heat in the flue gas is also used in the spray dryer 64 to dry the ash in the spray dryer.

As described above, flash tank 51 receives return water from the water spray, as well as the ash and other particulate matter. The water that does not flash in the tank and the ash that has been recovered from the product gas are piped from the tank to the spray water reservoir 62. The spray water reservoir acts as a holding tank for the water and as a settling tank for the ash. The required amount of make-up water is introduced into the spray water reservoir, and additional make-up water is supplied to the distillation system 60. The make-up water is necessary to replace the water lost to the reaction, to the product gas and to the water leaving the reservoir with the ash. Approximately equal amounts by weight of water and ash are piped from the reservoir to the spray dryer 64.

The spray dryer utilizes hot flue gas from the retort, as described above, to remove the water from the water ash mixture coming from the spray water reservoir. The spray dryer incorporates a filter on the gas discharge to assure that no fly ash is released to the atmosphere. A grate may be provided at the bottom of the reaction column, and a space below the grate may be provided for the accumulation of ashes. However, the retort may be operated so that almost all ash passes out through the top of the retort to be separated from the gas in the water spray 50, so that there would be no large accumulation of ashes in the space below the grate. A water tray may also be provided at the very bottom of the retort.

The product gas from the water spray is then fed to adsorption beds 56. The adsorption beds serve to remove the hydrogen sulphide from the gas, and also to remove other undesirable constituents. The resulting purified product coal gas is passed to a receiver 58, where it is stored until needed. A portion of the product gas in receiver 58 is fed back to the burners 32 of the retort to create the hot flue gas in the annular chamber 12, as mentioned above.

The adsorption beds 56 are formed of molecular sieve tanks which, in turn, consist of vessels containing molecular sieve pellets. Molecular sieves are crystalline structures of aluminum silicates which are capable of the selective entrapment of molecules according to size and polarity. Water and hydrogen sulphide molecules are trapped in the sieve pores and are thus removed from the product gas stream. The gas entering the adsorption beds 56 contains water and hydrogen sulphide, whereas the gas leaving the beds is dry and free of hydrogen sulphide.

When an individual molecular sieve adsorption bed 56 becomes saturated with water or hydrogen sulphide, the particular bed is shifted automatically to a "desorption" mode of operation. During the desorption mode, water is removed by depressurization and heating, and hydrogen sulphide is removed by a small heated stream of inert gas. The gas from the bed containing the hydrogen sulphide is directed to a Claus Plant 65, where the major part of the hydrogen sulphide is converted to sulphur vapor and water. The sulphur vapor is cooled and removed as liquid sulphur.

The gas effluent from the Claus Plant 65 is directed back through the molecular sieve adsorption bed 56 where the water and last traces of hydrogen sulphide are removed. The clean gas from the adsorption bed 56 is ready for use in pipelines, gas turbines, boilers or chemical processing without further compression.

The various mechanisms represented by the blocks of the system of the invention are well known per se to the art, and it is believed that a complete understanding of the system and apparatus of the invention may be obtained without the necessity for illustrating and describing the individual mechanisms in detail.

The materials fed into the retort 10 are coal, air and steam, and the product produced by the system is completely clean burning fuel gas. Unlike the prior art systems, the system of the invention produces a satisfactory fuel gas at high pressure without the use of oxygen, thereby providing a significant reduction in plant costs and energy usage. Significant improvements over earlier systems and apparatus are obtained by the construction of the retort which pre-heats the incoming air and steam, which adds heat to the reaction column through the retort walls, and which provides gas at high pressure without a large net expenditure of energy to achieve the pressure.

The development of space age materials, and specifically high temperature nickel alloys, makes it possible to operate the apparatus of the invention at temperatures high enough to radiate the required amount of heat into the entrained or fluidized bed contained in the retort. The equalized pressure on each side of the hot wall of the reaction column prevents rupture of the hot wall at elevated temperatures even though relatively high pressures are developed in the reaction column, and even though the strength of the hot wall material is relatively low at its operating temperature. The turbine compressor combination allows the achievement of high pressure without significant energy penalty.

It will be appreciated that although a particular embodiment of the apparatus of the invention has been shown and described, modifications may be made. It is intended in the following claims to cover the modifications which come within the spirit and scope of the invention.

What is claimed is:

1. Apparatus for producing a gas at a relatively high pressure comprising: a retort having a central reaction column and having an outlet for hot gas produced by the reaction column; means for introducing a pulverized carbon-containing fuel into the reaction column; means for introducing pressurized steam into the central reaction column to react therein with the pulverized fuel to produce the high pressure gas; wall means forming a tapered chamber surrounding said reaction column in coaxial relationship therewith said tapered chamber diminishes in area toward the top so as to achieve uniform heat transfer thereof; burner means coupled to said tapered chamber; compressor means for producing air at relatively high pressure; means for introducing compressed air from said compressor means into said tapered chamber; and means for introducing combustible gas into the tapered chamber to be burned by said burner means so as to produce pressurized hog flue gas passing through the tapered chamber at a high velocity to provide sufficient convective heat transfer to produce enough heat radiation into the central reaction column to react the carbon in the pulverized fuel with steam.

2. The apparatus defined in claim 1, and which includes turbine means for driving said compressor, and means for introducing hot flue gas from said tapered chamber to said turbine means to drive said turbine means.

3. The apparatus defined in claim 1, and which includes further wall means forming a second chamber surrounding the tapered chamber; and means for introducing water into said second chamber to be heated by heat from said tapered chamber and subsequently introduced as pressurized steam by said pressurized steam introducing means into said reaction column to react with the pulverized carbon-containing fuel.

4. The apparatus defined in claim 1, in which said pressurized steam introducing means includes pump means for causing steam at high pressure to be introduced into the reaction column to react with the pulverized carbon-containing fuel.

5. The apparatus defined in claim 1, in which said pressurized steam introducing means includes means in said tapered chamber for carrying steam for introduction into the reaction column, said steam being superheated by the hot flue gas in the tapered chamber.

* * * * *